US011535994B2

(12) United States Patent
Mettler

(10) Patent No.: US 11,535,994 B2
(45) Date of Patent: Dec. 27, 2022

(54) VEHICLE-MOUNTABLE CARGO CARRIER FOR PORTABLE RUMBLE STRIPS

(71) Applicant: PLASTIC SAFETY SYSTEMS, INC., Cleveland, OH (US)

(72) Inventor: Charles M. Mettler, Perry, OH (US)

(73) Assignee: PLASTIC SAFETY SYSTEMS, INC., Cleveland, OH (US)

( * ) Notice: Subject to any disclaimer, the term of this patent is extended or adjusted under 35 U.S.C. 154(b) by 168 days.

(21) Appl. No.: 16/964,458

(22) PCT Filed: Aug. 7, 2019

(86) PCT No.: PCT/US2019/045397

§ 371 (c)(1),
(2) Date: Jul. 23, 2020

(87) PCT Pub. No.: WO2020/033470

PCT Pub. Date: Feb. 13, 2020

(65) Prior Publication Data

US 2020/0370255 A1 Nov. 26, 2020

Related U.S. Application Data

(60) Provisional application No. 62/715,649, filed on Aug. 7, 2018.

(51) Int. Cl.
*E01F 9/70* (2016.01)
*E01F 9/529* (2016.01)

(52) U.S. Cl.
CPC ..... *E01F 9/70* (2016.02); *E01F 9/529* (2016.02)

(58) Field of Classification Search
CPC ..... B60P 1/4485; B60P 1/4492; B60P 1/50; B60P 3/40; B60P 9/00; B60R 9/06; B65H 1/04; B66D 3/20; E01F 9/529; E01F 9/70
See application file for complete search history.

(56) References Cited

U.S. PATENT DOCUMENTS 3,528,574 A * 9/1970 Denner ..... B60P 1/445 182/127
4,176,999 A * 12/1979 Thorley ..... A61G 3/062 280/166

(Continued)

FOREIGN PATENT DOCUMENTS

EP 2789745 10/2014
NL 1031311 9/2007

OTHER PUBLICATIONS

International Search Report and Written Opinion for corresponding International Patent Application No. PCT/US2019/045397 dated Nov. 5, 2019.

(Continued)

*Primary Examiner* — Glenn F Myers
(74) *Attorney, Agent, or Firm* — Renner, Otto, Boisselle & Sklar, LLP

(57) ABSTRACT

A cargo carrier for portable nimble strips that is mountable to a vehicle has a support surface that is configured to support multiple portable rumble strips. The support surface also is configured to move between a deployment position having a first width and a transit position having a second width that is less than the first width. The cargo carrier includes a frame that defines the support surface. In the illustrated embodiment, the support surface is divided along a major width dimension into at least three planar segments that are movable relative to one another to alter the overall width of the support surface, including a center portion and lateral portions extending from opposing sides of the center portion. The lateral portions are pivotably movable between extended positions aligned with the center portion in a horizontal orientation and retracted positions inclined relative to the center portion.

17 Claims, 3 Drawing Sheets

(56) References Cited

U.S. PATENT DOCUMENTS

| | | | | |
|---|---|---|---|---|
| 4,180,366 | A * | 12/1979 | Roth | A61G 3/068 280/166 |
| 4,664,584 | A * | 5/1987 | Braun | A61G 3/062 187/217 |
| 4,711,613 | A * | 12/1987 | Fretwell | A61G 3/062 414/921 |
| 6,379,102 | B1 * | 4/2002 | Kameda | A61G 3/062 414/921 |
| 8,556,145 | B1 | 10/2013 | Ezra | |
| 9,481,282 | B2 * | 11/2016 | Walker | B60P 1/435 |
| 2012/0187658 | A1 | 7/2012 | Wheeler et al. | |
| 2017/0282779 | A1 * | 10/2017 | Mettler | E01F 9/70 |

OTHER PUBLICATIONS

International Preliminary Report on Patentability dated Feb. 9, 2021, for International Patent Application No. PCT/US2019/045397.

* cited by examiner

VEHICLE-MOUNTABLE CARGO CARRIER FOR PORTABLE RUMBLE STRIPS

FIELD OF THE INVENTION

The invention relates to external cargo carriers for vehicles and, in particular, to a cargo carrier designed to receive a portable roadway warning device commonly referred to as a rumble strip.

BACKGROUND

Roadway warning devices, specifically the roadway warning devices commonly referred to as rumble strips, provide a perceptible noise and warning vibration when automotive vehicles, including both passenger vehicles and trucks, drive over the rumble strips. The noise and vibration are intended to warn the vehicle driver of an approaching condition that requires a lower speed or special attention, such as a work site, construction site, slow speed zone, checkpoint, toll booth, and so on, without alarming the driver and without adversely affecting the stability of the vehicle. Some types of rumble strips are intended to be permanently installed for long-term use, while others are intended to be portable for temporary use at work zones and other applications of relatively short duration. Portable rumble strips should be reusable, and also should have the ability to remain in place under heavy traffic, including heavy trucks at highway speeds.

To facilitate deploying and retrieving portable rumble strips, vehicle-mounted carriers and remotely-controlled arms have been developed.

SUMMARY OF THE INVENTION

Portable rumble strips often require multiple sections to span a lane of traffic, and each section may be relatively heavy, making it difficult for one person to lift each section without assistance. Because these portable rumble strips are temporary and often are deployed on working roadways, users must transport the rumble strips to and from the work site and quickly deploy and retrieve the rumble strips onto and from the roadway with minimal exposure of the workers to traffic on the roadway. Additionally, prior rumble strips often were made in multiple segments to facilitate storage, transportation, and deployment (and retrieval) of portable rumble strips that are long enough to span an entire width of a standard roadway lane. These segmented rumble strips may require assembly at the worksite, or may be folded and need to be unfolded before being deployed or after being retrieved. To minimize repetition, any reference herein to deployment of rumble strips is presumed to incorporate a corresponding retrieval of the rumble strips unless otherwise provided.

The present invention provides a system for transporting, deploying, and retrieving rumble strips that do not require on-site assembly and that are wide enough to span an entire width of a standard roadway lane. Standard roadway lanes are wider than the width of the vehicles traveling within the lane of the roadway, and thus the length of such rumble strips also is greater than the width of the vehicles traveling on the roadway. To prevent the rumble strip carrier from extending far beyond the width of the vehicle, while still providing means for transporting such long rumble strips, the rumble strip carrier provided by the present invention has multiple sections that are pivotable relative to each other to reduce the overall width of the carrier. Rumble strips have sufficient flexibility to bend with the pivoting sections. The pivoting sections may be substantially aligned during a deployment or retrieval operation to facilitate stacking or unstacking rumble strips to or from the carrier.

More particularly, the present invention provides a cargo carrier for portable rumble strips that is mountable to a vehicle. The cargo carrier includes a support surface that is configured to support multiple portable rumble strips and to move between a deployment position having a first width and a transit position having a second width that is less than the first width.

In one or more embodiments, the cargo carrier may include a frame that defines a volume for receiving the one or more portable rumble strips, the frame defining the planar support surface, and the planar support surface has a depth dimension and a width dimension greater than the depth dimension.

The planar support surface may be divided along the width dimension into at least two segments that are movable relative to one another to alter the overall width of the planar support surface.

The planar support surface may have a center portion and lateral portions extending from opposing sides of the center portion, the lateral portions being movable between extended positions aligned with the center portion in a horizontal orientation and inclined relative to the center portion in retracted positions.

The lateral portions may be hinged for pivoting movement relative to the center portion.

The cargo carrier may be provided in combination with a vehicle to which the cargo carrier is mounted. More particularly, the cargo carrier may be mounted to a front side of the vehicle.

The cargo carrier may be provided in combination with a vehicle to which the cargo carrier is mounted and a remotely-controlled device configured to deploy and retrieve portable rumble strips from a roadway that also is mounted to the vehicle.

The cargo carrier may include one or more upright elements extending in a common direction from the support surface to define an upwardly-opening volume for receipt of one or more portable rumble strips.

The present invention also provides a method for deploying and retrieving portable rumble strips from a roadway surface, comprising the steps of (i) mounting a support surface on a vehicle, the support surface being configured to support multiple portable rumble strips and to move between a deployment position having a first width and a transit position having a second width that is less than the first width; (ii) moving the vehicle from a first location to a second location removed from the first location while the support surface is in the transit position; (iii) moving the support surface from the transit position to the deployment position; and (iv) moving portable rumble strips from a roadway surface to the support surface or from the support surface to the roadway surface.

The method may further include the step of loading multiple portable rumble strips onto the support surface while the support surface is in the deployment position.

The step of moving the vehicle may occur while the support surface is in the transit position and after the step of loading multiple portable rumble strips onto the support surface.

The step of moving portable rumple strips from a roadway surface to the support surface or from the support surface to the roadway surface may include remotely controlling a device configured to deploy and retrieve rumble strips from a roadway.

The present invention further provides a cargo carrier for portable rumble strips that is mountable to a vehicle. The cargo carrier includes a support surface that is configured to support multiple portable rumble strips and to move between a deployment position having a first width and a transit position having a second width that is less than the first width, a frame defining the support surface and one or more upright elements extending in a common direction from the support surface to define an upwardly-opening volume for receipt of one or more portable rumble strips, and the support surface having a depth dimension and a width dimension greater than the depth dimension. The support surface may be divided along the width dimension into at least three planar segments that are movable relative to one another to alter the overall width of the support surface, including a center portion and lateral portions extending from opposing sides of the center portion, the lateral portions being pivotable between extended positions aligned with the center portion in a horizontal orientation and retracted positions inclined relative to the center portion.

Other features and advantages of the invention will be apparent from the following detailed description with reference to the accompanying drawings.

BRIEF DESCRIPTION OF THE DRAWINGS

In the accompanying drawings and description, the same or similar reference characters are used to refer to the same or similar features shown in different figures.

DETAILED DESCRIPTION

Figure 1:
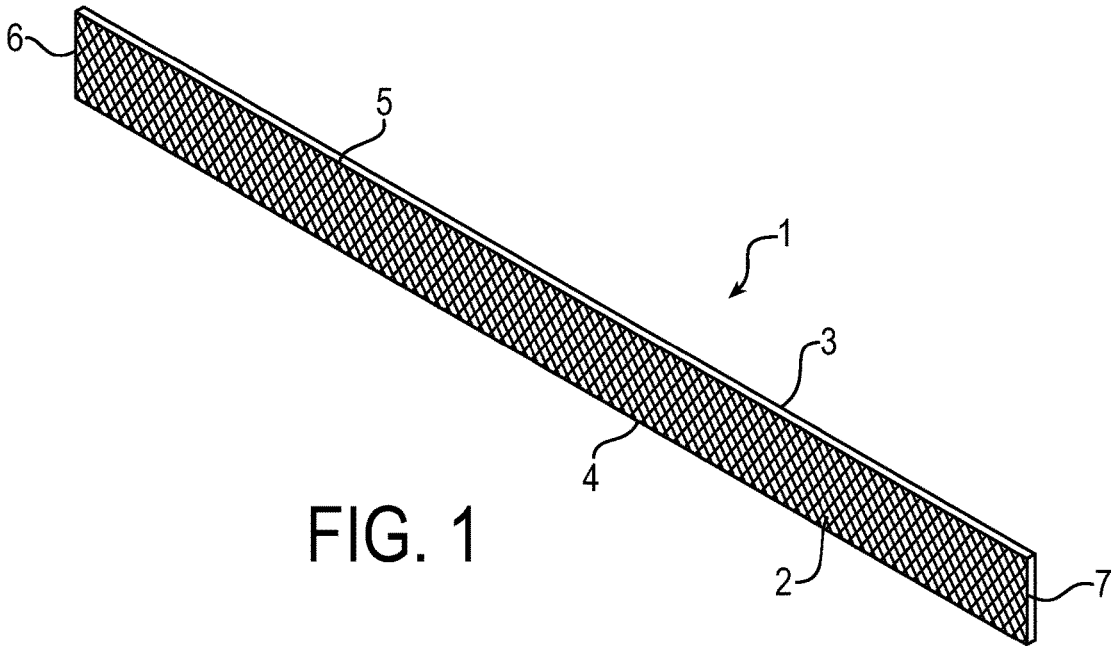
FIG. 1 is a perspective view of one form of portable rumble strip.

Because of the required weight to hold portable rumble strips in place on a roadway, the rumble strips can be difficult for one person to lift without assistance. Consequently, portable rumble strips have been made in sections of a length and weight suitable for one person to handle. But to span an entire width of a standard roadway lane, multiple sections generally have to be connected together. Because these portable rumble strips are temporary and often are deployed on working roadways, users must transport the rumble strips to and from the work site, potentially perform some assembly in the field, and quickly deploy the rumble strips onto the roadway with minimal exposure of the workers to traffic on the roadway. Consequently, segmented portable rumble strips may not be the ideal solution in all situations.

Some rumble strips are formed in a single piece, and are transported in a flat orientation, stacked one on top of another. Due to their weight, these rumble strips generally require multiple people to deploy and retrieve. Vehicles have been provided with remote-controlled arms for deploying and retrieving such portable rumble strips to and from the roadway, making it easy for a single worker to deploy the rumble strips. But those portable rumble strips have a length that is approximately the width of the vehicle or less, and thus do not span the entire width of a standard roadway lane.

The present invention provides a system for transporting and deploying rumble strips that are long enough to span an entire width of a standard roadway lane without any assembly on site. The present invention also provides a system for transporting and deploying rumble strips without changing the orientation of the rumble strip between transport and deployment. Avoiding the need to rotate the rumble strip during the transition from transportation to deployment and vice versa, or to have to fold or unfold the rumble strip, facilitates faster deployment and retrieval and simplifies the equipment.

Standard roadway lanes are wider than the width of the vehicles traveling within the lane of the roadway, and thus the length of such rumble strips also is greater than the width of the vehicles traveling on the roadway. To prevent the rumble strip carrier from extending far beyond the width of the vehicle during travel, while still providing means for transporting such long rumble strips, the rumble strip carrier provided by the present invention has multiple sections that are pivotable relative to each other to reduce the overall width of the carrier during transport to the worksite. The sections may be substantially aligned during a deployment or retrieval operation to facilitate stacking or unstacking rumble strips to or from the carrier, and then retracted to reduce the overall width of the carrier for travel to and from the worksite. As noted above, to minimize repetition any reference herein to deployment of rumble strips is presumed to incorporate a corresponding retrieval of the rumble strips unless otherwise provided. This system also allows for much heavier rumble strips, which are more stable and reliable when deployed on the roadway surface.

Figure 2:
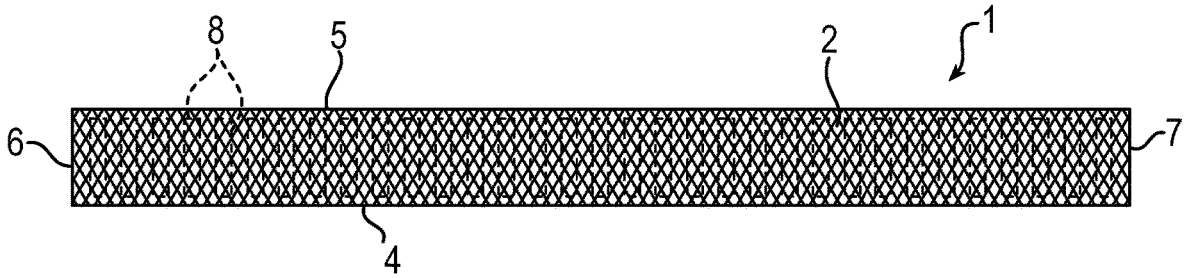
FIG. 2 is a top plan view of the rumble strip of FIG. 1.

Referring now to the drawings, in which like reference characters refer to like parts throughout the views, and initially to FIGS. 1 and 2, which show one form of elongated portable rumble strip 1. Each rumble strip 1 has a generally rectangular shape, with substantially flat top and bottom surfaces 2 and 3, relatively long opposing side edges 4 and 5 and relatively shorter opposing end edges 6 and 7, providing a portable rumble strip 1 with a substantially greater length dimension than width dimension. Each rumble strip 1 is desirably made of a suitable high strength, weather-resistant material such as polyurethane or other polymeric material with similar properties. This gives the rumble strip 1 some flexibility, allowing it to bend with the pivoting action of the movable sections of the rumble strip carrier, as described below.

Although the dimensions of available rumble strips may vary, each rumble strip is desirably of sufficient length to reach across a single highway lane, which in the U.S. is typically 11 feet (about 3.4 m) wide. Also, each rumble strip 1 has a width that is preferably between 8 inches and 16 inches (about 20 to 41 cm). Moreover, the rumble strips 1 are of sufficient thickness to create a noticeable audible and vibration warning to drivers of automotive vehicles, including trucks when driven over the rumble strips, but not so severe as to alarm the drivers, and without causing any adverse effect on the stability of the vehicles. To that end, the rumble strips preferably have a thickness of between ½ inch and 1 inch (about 1.3 to 2.5 cm).

Because each rumble strip by itself isn't heavy enough to remain in place under heavy traffic at highway speeds, a plurality of laterally spaced, transversely extending metal plates or bars 8, preferably made of steel or cast iron, are embedded within each rumble strip to provide the necessary ballast to keep each rumble strip in place preferably without having to use any adhesive or fasteners. This makes the rumble strips particularly easy to deploy and remove and reuse for work zones of relatively short duration. The metal plates or bars 8 run transversely across the width of the rumble strips 1 and provide stiffness in the transverse direction to help the side edges 4, 5 of the rumble strips resist curling in use.

The number and combined weight of the individual plates or bars embedded in the rumble strips should be sufficient to cause the rumble strips to stay in place under heavy traffic at highway speeds, but not make the rumble strips so heavy that they cannot easily be moved. For example, the overall weight of each rumble strip is desirably between 100 and 110 pounds (about 45 to 50 kg).

Suitable hand grip slots (not shown) may be provided in each rumble strip 1 adjacent to one or both ends 6 and 7 of the rumble strip 1. The hand grip slots make it easier to pick up each rumble strip so that it can be lifted or dragged as it is deployed or retrieved. Exemplary rumble strips are described in U.S. Pat. No. 7,736,087 and U.S. Patent Application Publication No. 2015/030390A1, both of which are hereby incorporated herein by reference.

Figure 3:
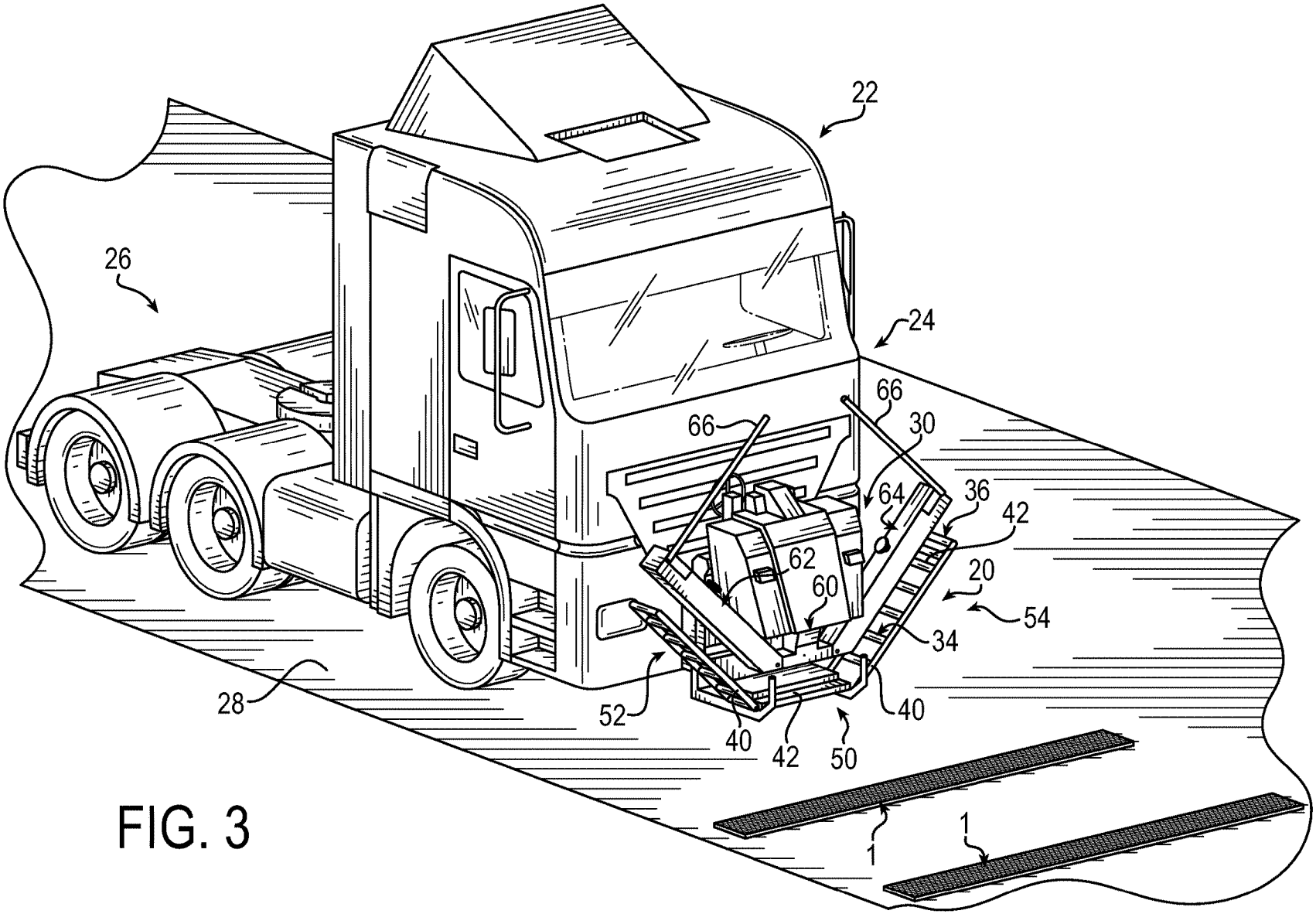
FIG. 3 is a schematic perspective view of an exemplary rumble strip deployment and retrieval device provided by the invention mounted to a front end of a vehicle in a retracted position.
Figure 4:
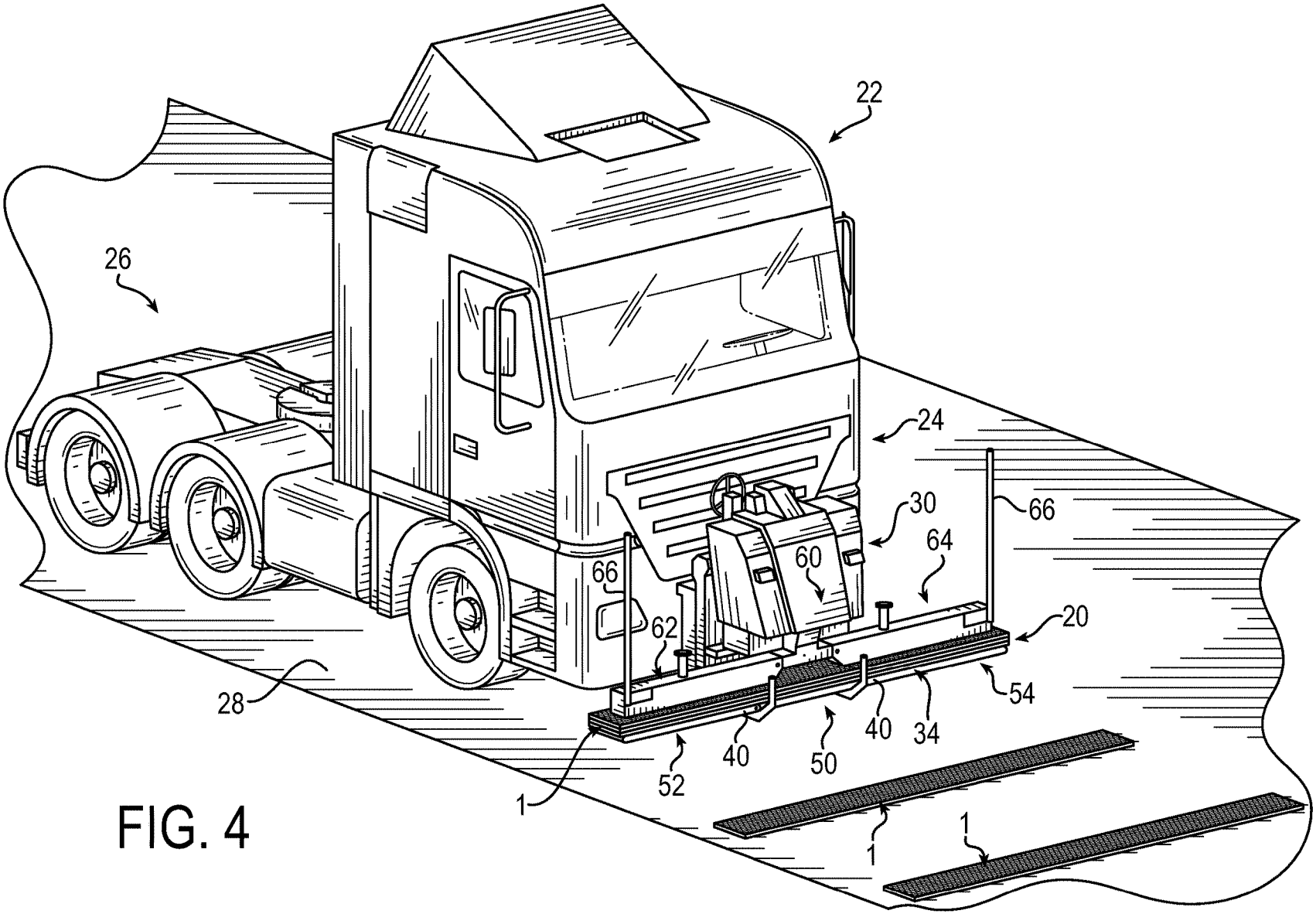
FIG. 4 is a schematic perspective view of an exemplary rumble strip deployment and retrieval device provided by the invention as shown in FIG. 3 in a deployed position.

Now referring to FIGS. 3 and 4, these figures show an exemplary cargo carrier 20 for portable rumble strips 1 that is mountable to a vehicle. The cargo carrier 20 may be provided separately, for mounting to a vehicle by the end user, or in combination with a vehicle 22 to which the cargo carrier 20 is mounted. Vehicles 22 generally have a front side 24 and a rear side 26, and the cargo carrier 20 may be mounted to the front side 24 of the vehicle 22, for example, as shown in FIGS. 3 and 4. The cargo carrier-vehicle combination, composed of the cargo carrier 20 mounted to the vehicle 22, also may be provided with a remotely-controlled device 30, such as a remotely-controlled pick-and-place robotic arm, also mounted to the vehicle 22. The remotely-controlled device 30 is configured to deploy and retrieve portable rumble strips 1 from a roadway 28. More specifically, the remotely-controlled device 30 is mounted to the vehicle 22 in such a way, including adjacent the cargo carrier 20, that the remotely-controlled device 30 can move rumble strips 1 between the roadway 28 and the cargo carrier 20, without needing to change the orientation of the rumble strip, perform any assembly operations, or to fold or unfold the rumble strip during the deployment process. The operator of the vehicle 22, a passenger, or another person may operate the remotely-controlled device 30 to deploy and to retrieve the rumble strips 1.

The cargo carrier 20 has a support surface 34 that is configured to support multiple portable rumble strips 1 in a common orientation in one or more stacks. The support surface 34 also is configured to move between an elongated deployment position (FIG. 4) having a first width and a more-compact transit position (FIG. 3) having a second width that is less than the first width.

The cargo carrier 34 includes a frame 36 that defines the support surface 34 and one or more upright elements 40 extending in a common direction from the support surface 34 to define an upwardly-opening volume for receipt of one or more portable rumble strips 1. The support surface 34 thus also may be referred to as the bottom wall or bottom surface. The upright elements 40 may be provided as discrete posts or planar segments that form upright side walls relative to the support surface 34.

The support surface 34 has a depth dimension and a major dimension, which may be referred to as a width or length dimension, that is greater than the depth dimension, generally corresponding to the length and width dimensions, respectively, of the rumble strips 1 although typically with larger dimensions. Specifically, the frame 36 includes frame members 42 that define the support surface 34 on which the rumble strips 1 may be stacked. The frame members 42 may be linear frame members, such as bars or rods, (as shown), and may be solid or tubular, with any cross-section that provides sufficient strength. Alternatively, or in addition to linear frame members, the frame members 42 may include planar frame members in the form of sheets, although generally, and particularly if used to form the support surface 34, the planar sheet should be perforated, such as a perforated metal mesh, for example, which can provide a continuous support surface, while still allowing for the passage of dirt and water therethrough. The frame also includes frame members 42 that define the upright elements 40. The frame 36 thus defines a parallelpiped, such as a rectangular, volume, within which rumble strips 1 may be received and retained during transport. The upright elements 40 may be formed from planar sheets or upright rods or posts (as shown) arranged to retain the rumble strips 1 on the support surface 34.

In the illustrated embodiment, the support surface 34 is divided along the major dimension, the width or length dimension, into at least two segments that are movable relative to one another to alter the overall width occupied by the support surface 34. The illustrated support surface 34 is divided into three segments, including a center portion 50 and lateral portions 52 and 54 extending from opposing sides of the center portion 50. The lateral portions 52 and 54 are pivotably movable between extended positions aligned with the center portion 50 in a horizontal orientation (the deployment position shown in FIG. 4) and retracted positions inclined relative to the center portion 50 (the transit position shown in FIG. 3). The lateral portions 52 and 54 may be hinged for pivoting movement relative to the center portion 50.

Similar to the support surface 34, the illustrated remotely-controlled device 30 includes a center portion 60 and lateral portions 62 and 64 pivotally movable relative to the center portion 60 in concert with the movement of the respective portions 50, 52, and 54 of the support surface 34. Visual control rods 66 are mounted to distal ends of the lateral portions 62 and 64 of the remotely-controlled device 30 and extend upward therefrom to help the operator of the vehicle 22 visually locate the distal ends of the remotely-controlled device 30, particularly when in the deployment position shown in FIG. 4.

The present invention also provides a method for deploying and retrieving portable rumble strips from a roadway surface. The method includes the steps of: (i) mounting a support surface on a vehicle, with the support surface being configured to support multiple portable rumble strips and to move between a deployment position having a first width and a transit position having a second width that is less than the first width; (ii) moving the vehicle from a first location to a second location removed from the first location while the support surface is in the transit position; (iii) moving the support surface from the transit position to the deployment position; and (iv) moving portable rumble strips from a roadway surface to the support surface or from the support surface to the roadway surface.

Additionally, the method may include the step of loading multiple portable rumble strips onto the support surface while the support surface is in the deployment position. The method may include the step of moving the vehicle while the support surface is in the transit position and after the step of loading multiple portable rumble strips onto the support surface. The method also may include the step of moving portable rumple strips from a roadway surface to the support surface or from the support surface to the roadway surface, by remotely controlling a device configured to deploy and retrieve rumble strips from a roadway.

In summary, the present invention provides a cargo carrier 20 for portable rumble strips 1 that is mountable to a vehicle 22. The cargo carrier 20 has a support surface 34 that is configured to support multiple portable rumble strips 1. The support surface 34 also is configured to move between a deployment position having a first width and a transit position having a second width that is less than the first width. The cargo carrier 20 includes a frame 36 that defines the support surface 34 and one or more upright elements 40 extending in a common direction from the support surface 34 to define an upwardly-opening volume for receipt of one or more portable rumble strips 1. The support surface 34 has a depth dimension and a major dimension, a width or length dimension, that is greater than the depth dimension. In the illustrated embodiment, the support surface 34 is divided along the major width dimension into at least three planar segments 50, 52, and 54 that are movable relative to one another to alter the overall width of the support surface 34, including a center portion 50 and lateral portions 52 and 54 extending from opposing sides of the center portion 50. The lateral portions 52 and 54 are pivotably movable between extended positions aligned with the center portion 50 in a horizontal orientation and retracted positions inclined relative to the center portion 50.

Although the invention has been shown and described with respect to certain embodiments, it is obvious that equivalent alterations and modifications will occur to others skilled in the art upon the reading and understanding of the specification. In particular, with regard to the various functions performed by the above-described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function of the herein illustrated exemplary embodiments of the invention. In addition, while a particular feature of the invention may have been disclosed with respect to only one embodiment, such feature may be combined with one or more other features as may be desired or advantageous to any given or particular application.

The invention claimed is:

1. A cargo carrier for portable rumble strips that is mountable to a vehicle, comprising:

a support surface having a depth dimension and a width dimension, the support surface is configured to support multiple portable rumble strips and to move between a deployment position having a first overall width in the width dimension and a transit position having a second overall width in the width dimension that is less than the first overall width, wherein the overall width is distance between a first end of the support surface and a second end of the support surface, both the first overall width and the second overall width are greater than the depth dimension, and the support surface is divided along the width dimension into at least two segments that are movable relative to one another to alter the overall width of the support surface between the first overall width and the second overall width; and a remotely-controlled device configured to deploy and retrieve portable rumble strips between the support surface and a roadway, the remotely-controlled device including movable portions that are movable in concert with the segments of the support surface to remain approximately parallel to respective sections of the support surface as the support surface moves between the deployment position and the transit position.

2. A cargo carrier as set forth in claim 1, comprising a frame that defines a volume for receiving the one or more portable rumble strips, the frame defining the support surface.

3. A cargo carrier as set forth in claim 1, wherein the support surface has three segments, a center portion and lateral portions extending from opposing sides of the center portion, the lateral portions being movable between extended positions aligned with the center portion in a horizontal orientation and inclined relative to the center portion in retracted positions, wherein the deployment position comprises the extended position, wherein the transit position comprises the retracted position.

4. A cargo carrier as set forth in claim 3, where the lateral portions are hinged for pivoting movement relative to the center portion.

5. A cargo carrier as set forth in claim 1, in combination with a vehicle to which the cargo carrier is mounted.

6. A cargo carrier as set forth in claim 1, in combination with a vehicle having a front side, where the cargo carrier is mounted to the front side of the vehicle.

7. A cargo carrier as set forth in claim 1, in combination with a vehicle to which the cargo carrier is mounted and the remotely-controlled device also is mounted to the vehicle to deploy and retrieve portable rumble strips from a roadway.

8. A cargo carrier as set forth in claim 1, comprising one or more upright elements extending in a common direction from the support surface to define an upwardly-opening volume for receipt of one or more portable rumble strips.

9. A method for deploying and retrieving portable rumble strips from a roadway surface, comprising the steps of:

mounting a support surface on a vehicle having a width dimension, a height dimension, and a depth dimension, the support surface being configured to support multiple portable rumble strips and to move between a deployment position having a first overall width in the width dimension and a transit position having a second overall width in the width dimension that is less than the first overall width, wherein the overall width is distance between a first end of the support surface and a second end of the support surface, wherein the support surface is divided into at least two segments that are movable relative to one another to alter the overall width of the support surface between the first overall width and the second overall width, the width of the support surface being parallel to the width dimension of the vehicle;

moving the vehicle from a first location to a second location removed from the first location while the support surface is in the transit position;

moving the support surface from the transit position to the deployment position; and moving portable rumble strips from a roadway surface to the support surface or from the support surface to the roadway surface;

wherein the step of moving portable rumple strips from a roadway surface to the support surface or from the support surface to the roadway surface includes remotely controlling a device configured to deploy and retrieve rumble strips from a roadway.

10. A method as set forth in claim 9, comprising the step of loading multiple portable rumble strips onto the support surface while the support surface is in the deployment position.

11. A method as set forth in claim 10, wherein the step of moving the vehicle occurs while the support surface is in the transit position and after the step of loading multiple portable rumble strips onto the support surface.

12. A cargo carrier for portable rumble strips that is mountable to a vehicle, comprising:

a support surface that is configured to support multiple portable rumble strips and to move between a deployment position having a first overall width and a transit position having a second overall width that is less than the first overall width, wherein the overall width is distance between a first end of the support surface and a second end of the support surface, a frame defining the support surface and one or more upright elements extending in a common direction from the support surface to define an upwardly-opening volume for receipt of one or more portable rumble strips, and the support surface having a depth dimension and a width dimension greater than the depth dimension;

wherein the support surface is divided along the width dimension into at least three planar segments that are movable relative to one another to remain parallel to corresponding movable portions of a remotely-controlled device to alter the overall width of the support surface, the three planar segments including a center portion and lateral portions extending from opposing sides of the center portion, the lateral portions being pivotable between extended positions aligned with the center portion in a horizontal orientation and retracted positions inclined relative to the center portion, the remotely-controlled device includes a center portion and lateral portions pivotally movable relative to the center portion, and is configured to move rumble strips between a roadway and the support surface without changing the orientation of the rumble strip.

13. The cargo carrier as set forth in claim 1, further comprising a visual control rod attached to a movable portion of the movable portions of the remotely-controlled device.

14. The cargo carrier as set forth in claim 3, wherein the remotely-controlled device has a center portion and lateral portions extending from opposing sides of the center portion of the remotely-controlled device, the lateral portions of the remotely-controlled device being pivotally movable relative to the center portion of the remotely-controlled device in concert with the movement of the lateral portions of the support surface.

15. The cargo carrier as set forth in claim 14, further comprising a first visual control rod attached to a distal end of one of the lateral portions of the remotely-controlled device and a second visual control rod attached a distal end of the another of the lateral portions of the remotely-controlled device.

16. A method for deploying and retrieving portable rumble strips from a roadway surface, comprising the steps of:

mounting a support surface on a vehicle having a width dimension, a height dimension, and a depth dimension, the support surface being configured to support multiple portable rumble strips and to move between a deployment position having a first overall width in the width dimension and a transit position having a second overall width in the width dimension that is less than the first overall width, wherein the overall width is distance between a first end of the support surface and a second end of the support surface, wherein the support surface is divided into at least two segments that are movable relative to one another to alter the overall width of the support surface between the first overall width and the second overall width, the width of the support surface being parallel to the width dimension of the vehicle;

moving the vehicle from a first location to a second location removed from the first location while the support surface is in the transit position;

moving the support surface from the transit position to the deployment position; and moving portable rumble strips from a roadway surface to the support surface or from the support surface to the roadway surface, wherein the support surface has three segments, a center portion and lateral portions extending from opposing sides of the center portion, the lateral portions being movable between extended positions aligned with the center portion in a horizontal orientation and inclined relative to the center portion in retracted positions, wherein the deployment position comprises the extended position, wherein the transit position comprises the retracted position, wherein the step of moving the support surface from the transit position to the deployment position comprises moving the lateral portions from the retracted position to the deployment position.

17. The cargo carrier as set forth in claim 12, further comprising a first visual control rod attached to a distal end of one of the lateral portions of the remotely-controlled device and a second visual control rod attached a distal end of the other of another lateral portion of the remotely-controlled device.

* * * * *